United States Patent [19]

Tetenborg et al.

[11] Patent Number: 4,580,391

[45] Date of Patent: Apr. 8, 1986

[54] APPARATUS FOR INFOLDING LATERALLY PROTRUDING WINGS OF A FILLED SACK ONTO ADHESIVE STRIPS PROVIDED ON THE TOP OF THE SACK

[75] Inventors: Konrad Tetenborg; Helmut Hüwelmann, both of Lengerich; Walter Eckhard, Bramsche, all of Fed. Rep. of Germany

[73] Assignee: Windmoller & Holscher, Lengerich, Fed. Rep. of Germany

[21] Appl. No.: 727,101

[22] Filed: Apr. 25, 1985

[30] Foreign Application Priority Data

Apr. 26, 1984 [DE] Fed. Rep. of Germany ..... 3415605
Sep. 4, 1984 [DE] Fed. Rep. of Germany ..... 3432517

[51] Int. Cl.[4] ..... B65B 51/00
[52] U.S. Cl. ..... 53/371; 53/378
[58] Field of Search ..... 53/371, 373, 378, 379, 53/380, 381 R, 387, 570, 571, 573

[56] References Cited

U.S. PATENT DOCUMENTS

| | | | |
|---|---|---|---|
| 3,831,343 | 8/1974 | Dominici | 53/378 X |
| 3,896,605 | 7/1975 | Chevalier | 53/371 X |
| 4,077,309 | 3/1978 | Marbot | 53/371 X |
| 4,510,736 | 4/1985 | Müller | 53/373 X |

FOREIGN PATENT DOCUMENTS 2013486 9/1971 Fed. Rep. of Germany ..... 53/371

*Primary Examiner*—James F. Coan
*Attorney, Agent, or Firm*—Fleit, Jacobson, Cohn & Price

[57] ABSTRACT

This invention relates to apparatus for infolding laterally protruding wings of a filled sack onto adhesive strips provided on the top of the sack. Said wings have been formed when the top end portion of the sack has been stretched flat and has been closed by a seam weld and has been folded down onto one half of the flattened top surface of the sack. Two folding bars or folding rods are movably mounted in a machine frame and protrude freely in the direction in which the sacks are conveyed. Said folding bars or rods are adapted to be lowered onto and raised from the top surface of each sack and have outer edges defining fold lines for the wings to be infolded. Holders are mounted in the machine frame on both sides of the sack standing upright on a support. Each of said holders carries a holder frame provided with a gripper arm for engaging one of the wings from below. An upper gripper arm for cooperating with the lower gripper arm is pivoted in each of said holder frames. The holders are movable between an outer portion, in which the ends of the gripper arms are disposed laterally of and above the sack, and an inner position, in which the lower gripper arms force the infolded wings onto the adhesive strips.

7 Claims, 1 Drawing Figure

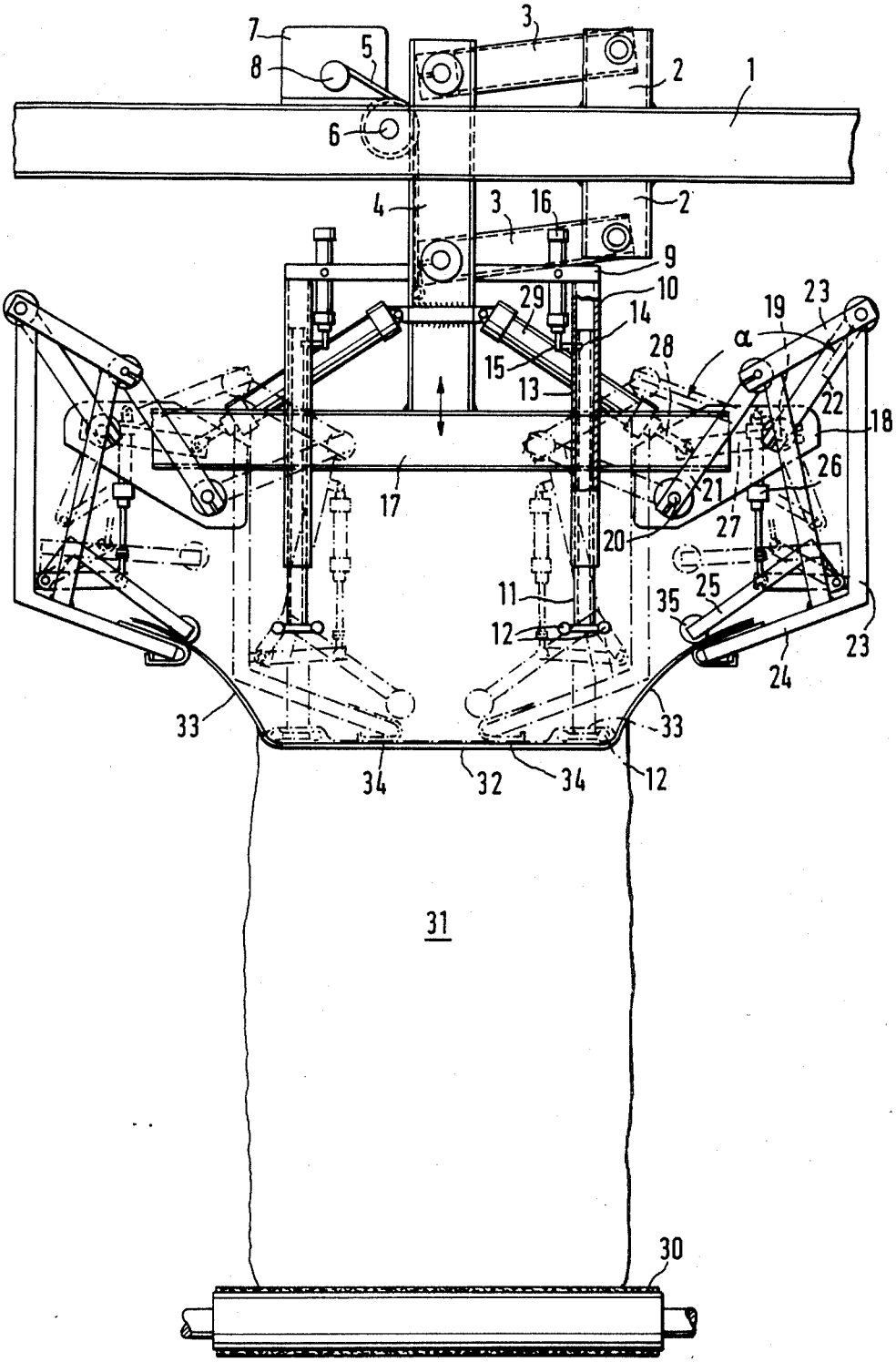
7
8
5
3
2
1
6
4
3
16
2
9
10
29
14
19
23
α
28
15
13
22
18
26
17
21
27
20
11
35
25
12
23
24
33
33
34
32
34
12
31
30

APPARATUS FOR INFOLDING LATERALLY PROTRUDING WINGS OF A FILLED SACK ONTO ADHESIVE STRIPS PROVIDED ON THE TOP OF THE SACK

BACKGROUND OF THE INVENTION

1. Field of the Invention

This invention relates to apparatus for infolding laterally protruding wings of a filled sack onto adhesive strips provided on the top of the sack, which wings have been formed when the top end portion of the sack has been stretched flat and has been closed by a seam weld and has been folded down onto one half of the flattened top surface of the sack.

2. Description of the Prior Art

A German Patent Application No. P 34 15 605.4 filed Apr. 26, 1984, and entitled "Apparatus for Closing Filled Sacks" discloses apparatus in which the top end portion of each sack is held in a stretched condition and the sack walls on both sides of said end portion are forced against the contents of the sack so that the sack is provided with a substantially flat top surface. The top end portion of the sack is subsequently closed by a seam weld and is then folded down onto and forced against adhesive strips provided on one half of the top surface of the sack. When the top end portion of the sack is stretched flat and is folded down and glued to the top surface of the sack in the manner described in that prior application, the sack is provided with laterally protruding wings, which consist of triangular side walls and a rectangular strip of the flattened portion of the top end portion of the sack, which rectangular strip is centrally joined to said side walls. Such wings must be eliminated if sacks, particularly large sacks, are to be provided which are neat in appearance and can be conveniently transported and stored.

SUMMARY OF THE INVENTION

It is an object of the invention to provide a device which is of the kind described first hereinbefore and by which the wings which laterally protrude from the filled sack can be infolded and forced against the adhesive strips provided on the top surface of the sack.

This object is accomplished in accordance with the invention in that two folding bars or folding rods are movably mounted in a machine frame and protrude freely in the direction in which the sacks are conveyed, said folding bars or rods are adapted to be lowered onto and raised from the top surface of each sack and have outer edges defining fold lines for the wings to be infolded, holders are mounted in the machine frame on both sides of the sack standing upright on a support, each of said holders carries a holder frame provided with a griper arm for engaging one of the wings from below, an upper gripper arm for cooperating with the lower gripper arm is pivoted in each of said holder frames, and the holders are movable between an outer portion, in which the ends of the gripper arms are disposed laterally of and above the sack, and an inner position, in which the lower gripper arms force the infolded wings onto the adhesive strips.

By means of the apparatus in accordance with the invention the wings to be infolded can be reliably gripped and infolded and forced against the adhesive strips which have been formed by means of the apparatus disclosed in German patent application No. P 34 15 605.4.

Further aspects of the invention will be recited in the dependent claims.

BRIEF DESCRIPTION OF THE DRAWING

The single FIGURE of the drawing is a front elevation showing apparatus for infolding the wings which laterally protrude from a filled sack.

DETAILED DESCRIPTION OF THE PREFERRED EMBODIMENT

An illustrative embodiment of the invention will now be described more in detail with reference to the drawing.

The device comprises a machien frame, which consists of side frames, not shown, which are interconnected by the crossbeam 1. Brackets 2 are wleded to the crossbeam 1 on both sides thereof, and parallel links 3 are pivoted to said brackets. At those ends which are remote from the brackets 2, the parallel links 3 are pivoted to an arm 4, which can be adjusted in height. For this purpose the arm 4 is connected to one end of a rope 5, which is trained around a pulley 6 and can be wound on and unwound from a rope drum 8, which is driven by a motor 7. Holders 9 are welded to the arm 4 on opposite sides thereof and extend outwardly in mutually opposite directions. Depending vertical guide tubes 10 are connected to the outer ends of the holders 9. A tube 11 is slidably mounted in each of the guide tubes 10. Pressure-applying fingers 12 are joined to the free lower end of each tube 11. To permit a diplacement of the tubes 11, each guide tube 10 is formed with a slot 13 through which a pin 14 extends, which has been screwed into the slidable tube 11. Each pin 14 is engaged at its outer end by the piston rod 15 of a piston-cylinder unit 16, which is carried by the holder 9.

A transversely extending carrying yoke 17 is welded to the lower end of the arm 4 and is fixedly connected at each end to two mounting plates 18. Two shafts 19 and 20 are rotatably mounted in the mounting plates 18 at each end of the yoke 17. Links 21 and 22 are mounted on the shafts 20 and 19, respectively. At those ends which are remote from the shafts 19 and 20, the links 21 and 22 carry a gripper frame 23, which is provided with a fixed gripping arm 24 and with a pivoted gripping arm 25. By means of the piston-cylinder unit 26 the pivoted gripping arm 25 is pivotally movable from the position indicated by solid lines to the position indicated by dotted lines. The piston-cylinder unit 26 is connected to the gripper frame 23. A pivoted lever 27 is clamped on the shaft 19 and at its free end is connected to the piston rod 28 of a piston-cylinder unit 29. The latter is mounted on the arm 4.

In the operation of the apparatus, a filled large sack 31 is fed by a belt conveyor 30. By means of the apparatus disclosed in German patent application No. P 34 15 605.4 that sack has already been closed by a seam weld at the open to end portion 32 of the sack and the top end portion of the sack has been folded down. In that apparatus, two adhesive strips have been applied to the top surface of the sack so that the wings can be fixed by being infolded and forced against said adhesive strips.

Said wings are formed by laterally protruding portions 33 of the top end portion 32 which has been folded down. By guide plates, not shown, said wings are held in such an orientation that the wings are moved between the stationary gripping arms 24 and the opened pivoted gripping arms 25 during the movement of the sack by the belt conveyor 30. When the wings 33 have entered between the gripping arms 24 and 25, the gripping arms 25 are pivotally lowered against the gripping arms 24 so that the laterally protruding wings 33 are gripped by the two grippers. While the wings 33 are gripped, the pressure-applying fingers 12 are lowered to the position indicated by dotted lines. Thereafter the piston-cylinder units 29 are actuated to pivotally move the gripper frames 23 and the gripping arms carried by said frames about the shafts 19 and 20 from their position indicated by solid lines to their position indicated by dotted lines. As a result, the laterally protruding wings 33 are infolded onto the adhesive strips 34 and are forced against the latter by the fixed gripping arms 24. It is apparent from the drawing that rollers 35 are carried by the pivoted gripping arms 25 at their free ends so that sack material can be pulled out of each gripper during the infolding operation. After the infolding operation the gripping arms 25 are lifted of the sack and the gripper frames are turned back about the pivots 19 and 20 through the angle $\alpha$ to their position indicated by solid lines. Because the pressure-applying fingers 12 are connected only at one end to the slidable tubes 11, the sack 31 can not be removed from the fingers by the belt conveyor 30 when the same has been restarted to carry off the sack 31 in the direction toward the free ends of the fingers.

Because different sacks may be filled to different levels, the level to which a given sack has been filled is detected by a suitable sensor, not shown, and in dependence on the detected level the carrying yoke 17 is adjusted in height by means of the motor 7 and the rope 5. But the levels to which different sacks may be filled will differ only by a few centimeters so that the lateral displacement imparted to the gripping arms 24 by the parallel links as a result of the vertical adjustment of the carrying yoke 17 will be so small that this will not adversely affect the operation of the apparatus.

We claim:

1. Apparatus for infolding laterally protruding wings of a filled sack onto adhesive strips provided on the top of the sack, which wings have been formed when the top end portion of the sack has been stretched flat and has been closed by seam weld and has been folded down onto one half of the flattened top surface of the sack, characterized in that two folding bars or folding rods are movably mounted in a machine frame and protrude freely in the direction in which the sacks are conveyed, said folding bars or rods are adapted to be lowered onto and raised from the top surface of each sack and have outer edges defining fold lines for the wings to be infolded, holders are mounted in the machine frame on both sides of the sack standing upright on a support, each of said holders carries a holder frame provided with a gripper arm for engaging one of the wings from below, an upper gripper arm for cooperating with the lower gripper arm is pivoted in each of said holder frames, and the holders are movable between an outer portion, in which the ends of the gripper arms are disposed laterally of and above the sack, and an inner position, in which the lower gripper arms force the infolded wings onto the adhesive strips.

2. Apparatus according to claim 1, characterized in that each holder comprises two parallel links, which are pivoted on axes extending transversely to the wings, and which carry a winglike frame that constitutes a connecting rod, the upper gripping arm is movable by a fluid-operable piston-cylinder unit, and piston-cylinder units are provided for moving the parallel links between an upper position, in which the free ends of the gripping arms are disposed laterally of and above the sack, and a lower position, in which the lower gripping arms force the infolded wings against the adhesive strips.

3. Apparatus according to claim 1, characterized in that the support is constituted by a belt conveyor and that lateral guiding plates or guiding rods are connected to the machine frame and adapted to guide the wings to pass between the gripping arms in the station in which the wings are infolded.

4. Apparatus according to claim 1, characterized in that the parallel links which carry the gripping arms are pivoted to a carrying member, which is mounted in the machine frame and adapted to be lifted and lowered by drive means.

5. Apparatus according to claim 1, characterized in that the folding bars or folding rods are carried by vertically extending carriers, which are adapted to be lifted and lowered by drive means in vertically extending guides, which are connected to the carrying member.

6. Apparatus according to claim 1, characterized in that a roller is provided at the free end of each upper gripping arm.

7. Apparatus according to claim 1, characterized in that a convex shoe or plate is carried by each of the lower gripping arms at its free end.

* * * * *